US008172270B2

(12) United States Patent
Rossing

(10) Patent No.: US 8,172,270 B2
(45) Date of Patent: May 8, 2012

(54) LUGGAGE TAG SYSTEM, DEVICE AND METHOD

(76) Inventor: Peter Rossing, Portland, OR (US)

( * ) Notice: Subject to any disclaimer, the term of this patent is extended or adjusted under 35 U.S.C. 154(b) by 285 days.

(21) Appl. No.: 12/683,562

(22) Filed: Jan. 7, 2010

(65) Prior Publication Data

US 2011/0163529 A1 Jul. 7, 2011

(51) Int. Cl.

| | |
|---|---|
| ***B42D 15/00*** | (2006.01) |
| ***G09C 3/00*** | (2006.01) |
| ***G09F 3/20*** | (2006.01) |
| ***G09F 3/18*** | (2006.01) |

(52) U.S. Cl. ..... 283/80; 283/75; 40/6; 40/649; 40/654.01

(58) Field of Classification Search ..... 283/70, 283/75, 80; 40/6, 649, 654.01, 124.06, 775
See application file for complete search history.

(56) References Cited

U.S. PATENT DOCUMENTS

| | | | | |
|---|---|---|---|---|
| 4,180,284 | A * | 12/1979 | Ashley | 283/70 |
| 6,347,467 | B1 * | 2/2002 | Meyer | 40/124.06 |
| 6,364,365 | B1 * | 4/2002 | Caplan | 283/75 |
| 6,671,987 | B1 * | 1/2004 | Fenton | 40/6 |
| 2003/0061751 | A1 * | 4/2003 | Zoland | 40/638 |
| 2007/0108005 | A1 * | 5/2007 | Augenstein et al. | 190/101 |
| 2009/0307945 | A1 * | 12/2009 | Bopp et al. | 40/6 |

* cited by examiner

*Primary Examiner* — Edward Tolan
*Assistant Examiner* — Kyle Grabowski
(74) *Attorney, Agent, or Firm* — Peter A Haas Esquire LLC

(57) ABSTRACT

A system of the present invention couples via a lanyard to a piece of luggage. The system includes a holder having three pockets. A first mask having a first shape and first color card inserts in the first pocket, a second mask and second color card inserts in the second pocket, and an identification card inserts into a third pocket. The system further includes extra color cards and extra masks to provide a traveler with many combinations of colors, patterns, shapes and sequences to identify their luggage.

6 Claims, 2 Drawing Sheets

LUGGAGE TAG SYSTEM, DEVICE AND METHOD

BACKGROUND

This invention relates to identification tags and systems for luggage.

Many travelers attempt to uniquely identify their luggage to allow quick and easy identification of checked bags and to prevent confusion. Many different identification attempts are known, including tying a colored ribbon to the handle of the bag or placing colored or whimsical stickers over the bag. However, most commonly travelers use tasteful luggage tags—many of which are supplied by the manufacturer of the luggage. Accordingly, manufacturers try to provide a distinctive identification tag on all luggage items in their lines. Most travelers understand that the luggage itself cannot readily be distinguished from similar luggage from another manufacture, and that many other travelers will have the exact same make and model bag as their own. Thus, in most instances the only way that a particular luggage item can be identified is by looking at a personal identification card inserted in the identification tag, which often cannot be viewed until the luggage item is so close as to make it difficult to both identify the item and retrieve it from the carousel before it moves out of reach.

Adding to the difficulty, many tags incorporate flap-covered windows to ensure the anonymity of the owner. In those instances, the traveler has to open the flap and view the ID card in order to identify his/her luggage item which makes it all the more difficult to identify and retrieve the item.

Attempts to improve the status quo in luggage tags include the reference of U.S. Pat. No. 6,671,987 issued to Fenton on 6 Jan. 2004. Fenton teaches a luggage identification tag consisting of an envelope assembled from front and rear members of natural leather and a transparent plastic sheet sandwiched between the two leather members. The rear member includes a flap, formed from a U-shaped cut. A tongue protruding from the front member overlaps the flap and snap fastener fastens the cover to the tongue. An ID card inserts between the two members, oriented to present the owner's information when the flap is unfastened and opened from the rear member. The front member includes a color card window that exposes a color card at all times. The color card is selected from several different colors enabling the owner to select a color of choice and thereby serving as a first indicator of ownership—however still requiring a reading of the ID portion of the tag to confirm unique ownership of the luggage associate with this tag.

And, U.S. Pat. No. 6,364,365 issued to Caplan on 2 Apr. 2002 teaches an adaptable luggage identification system including combinations of adhesive stickers, plastic tags, business card holders and other envelope-type tags having various colors and shapes. Specifically, in one embodiment a flexible, clear-plastic card with distinctive patterns in assorted colors.

And, U.S. Pat. No. 4,180,284 issued to Ashley on 25 Dec. 1979 teaches a kit for making and identifying luggage including a tag having distinctive geometrical shapes having a color selected from a set of colors. The tag consists of a planar label with an adhesive coating on the backside and a combination of a color and one geometric shape covering a significant portion of the front face. Further, a large block alphanumeric character locates within the borders of the geometrical shape.

Despite these attempts to improve upon the status quo, there remains yet a need for an economical to produce, simple to operate, easy to identify from greater distances, luggage tag system and method of use. Such an improved system should provide for multiple combinations of possible display elements to increase the probability that a given traveler's luggage has a unique combination of luggage color, luggage manufacture, and an easy to read I.D. tag. Such an improved tag need not replace existing tags that include the personal identification of the traveler, but rather, should be a system that augments this and focuses solely on uniquely identifying luggage from a greater distance than is currently possible.

SUMMARY OF THE INVENTION

The present invention contemplates a device, method and system for a luggage tag that includes a see-through envelope and two interchangeable components adapted for simultaneous use. This system enables a wide variety of unique color and shape combinations to provide the owner of luggage an easy and quick instant identification from a distance greater than existing luggage tags. The present invention includes a plurality of solid color chips and a plurality of shape masks that insert over the chip.

Although intended primarily as an easy visual identification system for luggage in a travel setting, the usefulness of the invention extends to any situation in which the owner of a case, bag, or similar article might want an easy visual means of identification or personalization to confirm ownership of a bag.

This invention can augment or replace existing ID tags, as it provides a means of instantly recognizing one's luggage from a distance by the combination of shape and color in a single, viewable from both sides, luggage tag. The invention also provides a means for capturing the ID information of the luggage owner, but only as a secondary and final confirmation of ownership after the luggage has been identified visually.

Advantages of the present invention and key characteristics include:

Unique shapes used in combination with colors provides limitless combinations with which luggage owners can create their own personalized identifiers;

Two-sided viewing of the color/shape combination;

Slim design;

Easy system to augment with additional colors and shapes expanding the number of unique combinations available to use as identifiers;

Easy to use, customizable system of identification with interchangeable and reusable components (as opposed to adhesive stickers or tear-off labels that can only be used once); and Simple-to-manufacture and cost-effective design.

DRAWING

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

The present invention contemplates a system 10 for identifying luggage. The system consists of components that can be combined in multiple combination providing a wide-variety of unique combinations of colors and shapes so that a traveler can easily and uniquely identify the luggage. And, should the traveler wish to alter the unique combination—whether on a whim or because his or her pattern is repeated on similar luggage belonging to another traveler—the modular nature of the system enables for quick and easy substitution of components.

Figure 1:
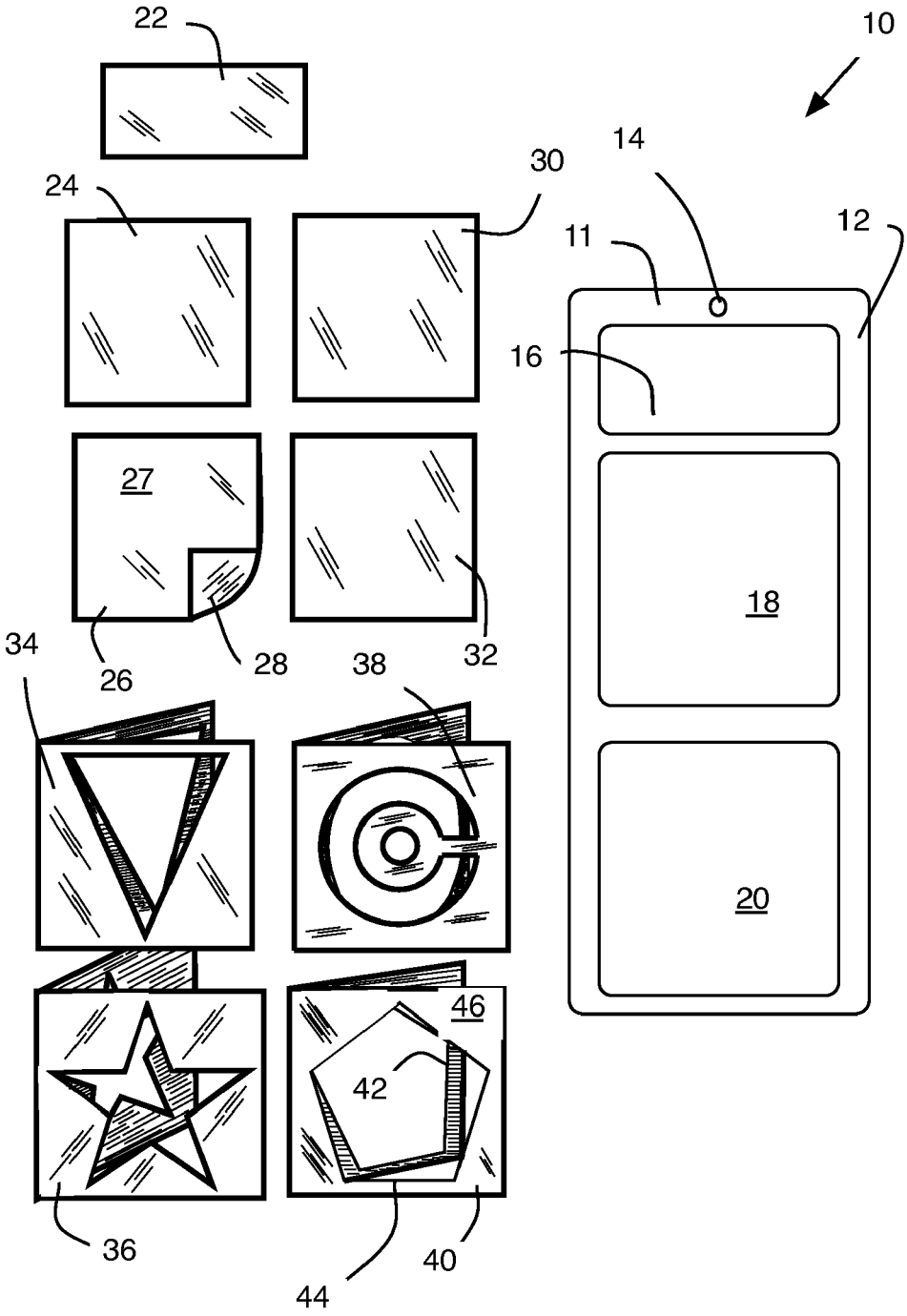
FIG. 1 illustrates a top view of one embodiment according to the present invention.

FIG. 1 shows a system according to a first preferred embodiment of the present invention. The system 10, such as a kit sold or presented to a traveler, comprises three essential elements: a holder 11, multiple colored cards (such as cards 24, 26, 30 and 32), multiple masks with each mask having a unique shape (such as masks 34, 46, 38, and 4). Additionally a kit includes an identification card 22 and a means for attaching the holder to a piece of luggage (not shown in FIG. 1).

The holder 11 includes a holder body 12 having a width substantially about 2.5-inches wide, a length substantially about 6-inches long and a nominal thickness. The holder body carries three pockets. A first pocket 16 has an opening adapted to slidably receive an identification card 22, and such identification cards are well understood in the art. The pocket 16 includes an open top portion, or preferably an open side portion, for receiving the card and an overlapping flap portion to prevent the card from inadvertently sliding out. The overlapping flap portion extends sufficiently to be able to be tucked into the pocket, as would be well appreciated by those of ordinary skill in this art. This first pocket is substantially about 0.75-inch in length and slightly smaller than about 2.25-inches in width; however, it would be understood that other sizes for this first pocket would work equally well.

The holder further includes a second pocket 18 and third pocket 20, both the second and third pocket are substantially identical and include a height between about 2.25-inches tall by about 2.25 inches wide. The second and third pockets adapt to slidably receive a combination mask and color card (described further herein). And each of these pockets include an open top, or preferably, side portion for receiving the card and an overlapping flap portion to prevent the card from inadvertently sliding out. The overlapping flap portion extends sufficiently to be able to be tucked into the pocket, as would be well appreciated by those of ordinary skill in this art.

Figure 2:
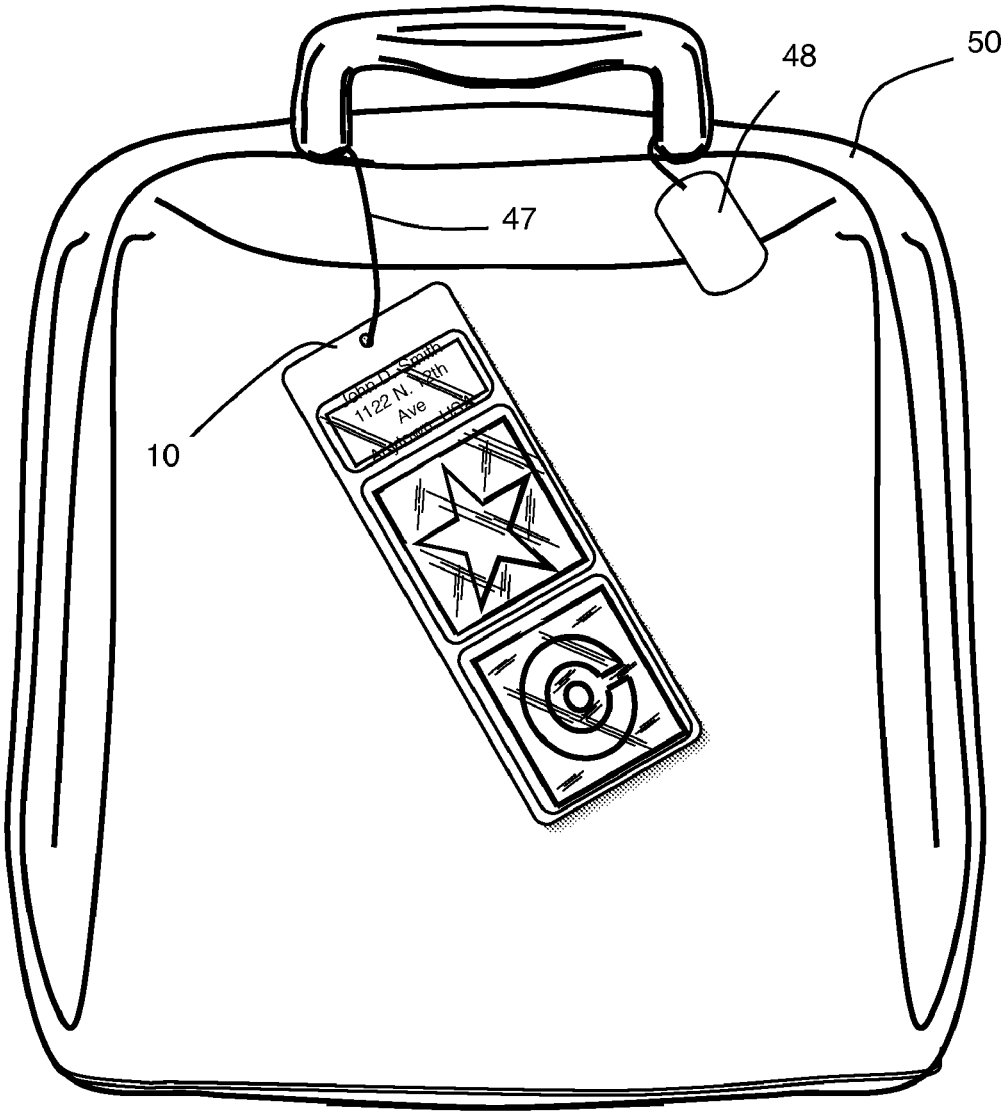
FIG. 2 is shows the first embodiment of the present invention relative to a piece of luggage.

The holder further includes a means for coupling the holder body to a piece of luggage. This means, for example, includes a through hole surrounded by a circular edge 14 and a linking means, such as a tether, lanyard, rope, chain or other similar and well understood mechanism as represented in FIG. 2 as linking means 47.

One particularly well-suited material for the holder would be transparent, colorless vinyl, commonly used in sheet form by manufacturers of name tags holders and similar card holders. And, the cards and masks are made from thin, semi-rigid plastic.

This system 10 further includes a plurality of colored cards, preferably four or more colored cards. A kit according to this first preferred embodiment includes four colored cards 24, 26, 30, and 32—each of which is a unique color. For a given card, for example card 26 the front 27 and back 28 are of the same color. For example, card 26 is yellow, card 24 is red, card 30 is blue, and card 32 is orange. In alternative embodiments the cards may also include unique patterns to further provide additional combinations of colors patterns and shapes to easier enable a traveler to uniquely identify his or her luggage.

Each colored card inserts between folds of any given mask of the plurality of masks in the kit. In this first preferred embodiment, the kit or system 10 includes at least four unique masks, such as masks 34, 36, 38 and 40. Each mask includes a front half 36 hingably connected to a back half 42. Both the front and back halves include the same cut-out (or stencil or negative pattern of a transparent space surrounded by a solid, typically white or neutral color, background) of a shape 44 so that when a colored card is inserted between the halves the same shape/color combination is viewable whether viewed from the front or the back. For example, the system 10 includes a mask 34 having a triangular cut-out, a mask 36 have a star-shaped cut-out, a mask 38 having concentric circles cut-out, and a mask 40 having a pentagonal cut-out. Any number of different shapes would work equally well. And, in fact, it is desirable to have kits with different colors and shapes to increase the likelihood that a given traveler's chosen combination is not repeated by a fellow traveler.

Supplemental kits containing additional masks having additional unique shape cut-out and additional color and/or patterned cards can increase the possible combinations to ensure that the traveler has a unique means for identifying his or her luggage.

An additional benefit of the present invention is appreciated due to the physical size of the system in combination with the brightly colored cards and transparent sleeve—it is large enough and provides enough visual contrast to be readily viewed and deciphered from a distance. For example, as a traveler watches luggage move on a conveyor belt at the baggage claim, the two-sided large tag system 10 is easily viewable.

FIG. 2 shows a system 10 of the present invention coupled via a lanyard 47 to a piece of luggage 50 having a conventional tag 48. The conventional tag may be omitted or may be used as a redundant identification means. The convention tag would typically include the owners name and phone number, perhaps the address, or perhaps a business card. As displayed, the holder includes a first mask (star shape) having a first color card inserted in a first pocket and a second mask (concentric circle shape) having a second color card inserted in a second pocket and an id card in a third pocket. Additional components of the system, an extra two mask and two color-cards are not shown in this figure.

This system, accordingly, an improved system for identifying luggage from a distance comprises a plurality of mask elements, each mask element comprising a first face and a second face, each face having a common two-dimensional shape removed from a center portion so that the corresponding face surrounds a void outlining the two-dimensional shape, wherein the same shape arranges on both the first and second faces;

a plurality of color cards, each color card having a first side and an oppositely disposed second side, each side comprising the same color and pattern, the color card being selectively insertable between the first face and second face of the at least one mask element whereby the combination of the color card and mask element creates unique pairing of color and pattern and two-dimensional shape; and at least one transparent, substantially flat housing comprising a first pocket adapted to selectively slidably receive a first mask element of the plurality of mask elements with a first color card of the plurality of color cards so that the unique pairing of color and pattern and two-dimensional shape is visible from either side of the housing and the housing further comprising a second pocket adapted to selectively slidably receive a second mask element with a second color card so to present a second unique color and pattern and shape combination.

Although the invention has been particularly shown and described with reference to certain embodiments, it will be understood by those skilled in the art that various changes in form and detail may be made without departing from the spirit and scope of the invention.

I claim:

1. An improved system for identifying luggage from a distance, the system comprising:

a plurality of mask elements, each mask element comprising a first face and a second face, each face having a common two-dimensional shape removed from a center portion so that the corresponding face surrounds a void outlining the two-dimensional shape, wherein the same shape arranges on both the first and second faces;

a plurality of color cards, each color card having a first side and an oppositely disposed second side, each side comprising the same color and pattern, the color card being selectively insertable between the first face and second face of the at least one mask element whereby the combination of the color card and mask element creates unique pairing of color and pattern and two-dimensional shape; and at least one transparent, substantially flat housing comprising a first pocket adapted to selectively slidably receive a first mask element of the plurality of mask elements with a first color card of the plurality of color cards so that the unique pairing of color and pattern and two-dimensional shape is visible from either side of the housing and the housing further comprising a second pocket adapted to selectively slidably receive a second mask element with a second color card so to present a second unique color and pattern and shape combination.

2. The system of claim 1 wherein:

the plurality of mask elements comprises at least four mask elements; and the plurality of color cards comprises at least four color cards, each card comprising a solid block of color with no patterning.

3. The system of claim 1 further comprising:

a third pocket adapted to slidably receive an identification card.

4. A method of identifying luggage, the method comprising:

providing a kit comprising a plurality of mask elements, each mask element comprising a first face and a second face, each face having a two-dimensional shape on a center portion so that the corresponding face surrounds a void outlining the two-dimensional shape, wherein the same shape arranges on both the first and second faces;

a plurality of color cards, each color card having a first side and an oppositely disposed second side, each side comprising the same color and pattern, the color card being selectively insertable between the first face and second face of the at least one mask element whereby the combination of the color card and mask element creates unique pairing of color and pattern and two-dimensional shape; and at least one transparent, substantially flat housing comprising a first pocket adapted to selectively slidably receive a first mask element of the plurality of mask elements with a first color card of the plurality of color cards so that the unique pairing of color and pattern and two-dimensional shape is visible from either side of the housing and the housing further comprising a second pocket adapted to selectively slidably receive a second mask element with a second color card so to present a second unique color and pattern and shape combination; and providing at least four color cards each color card having a unique color or a unique pattern or both; and providing at least four mask elements, each mask element having an outline feature surrounding a void of unique two-dimensional shape.

5. The method of claim 4 further comprising:

providing a linking member to couple the housing to the luggage.

6. The method of claim 4 further comprising:

providing at least a fifth mask element and at least a fifth color card as an accessory kit.

* * * * *